US005232059A

United States Patent [19]

Peterson

[11] Patent Number: 5,232,059

[45] Date of Patent: Aug. 3, 1993

[54] APPARATUS FOR MIXING AND INJECTING A SLURRY INTO A WELL

[75] Inventor: Ellis M. Peterson, Wassenaar, Netherlands

[73] Assignee: Marathon Oil Company, Findlay, Ohio

[21] Appl. No.: 744,552

[22] Filed: Aug. 13, 1991

[51] Int. Cl.[5] ..... E21B 21/06

[52] U.S. Cl. ..... 175/206; 137/893

[58] Field of Search ..... 175/72, 206, 207, 66; 137/888, 893

[56] References Cited

U.S. PATENT DOCUMENTS

| | | | |
|---|---|---|---|
| 2,005,800 | 6/1935 | O'Boyle | 259/4 |
| 2,135,969 | 11/1938 | Donaldson | 137/893 X |
| 2,372,957 | 4/1945 | Keefer | 51/12 |
| 2,908,227 | 10/1959 | McDougall | 137/893 X |
| 3,166,086 | 1/1965 | Holmes | 137/893 X |
| 3,171,427 | 3/1965 | McAlpine | 137/893 X |
| 3,797,707 | 3/1974 | Jenike et al. | 222/193 |
| 4,028,009 | 6/1977 | Gudzenko et al. | 417/163 |
| 4,368,757 | 1/1983 | Finger | 137/893 X |
| 4,444,277 | 4/1987 | Lewis | 175/66 |
| 4,799,552 | 1/1989 | Acree | 166/305 |
| 4,944,347 | 7/1990 | Richard et al. | 166/278 |

FOREIGN PATENT DOCUMENTS

| | | | |
|---|---|---|---|
| 41057 | 7/1958 | Poland | 175/72 |

*Primary Examiner*—Ramon S. Britts
*Assistant Examiner*—Roger J. Schoeppel
*Attorney, Agent, or Firm*—Jack L. Hummel; Jack E. Ebel

[57] ABSTRACT

The invention is an apparatus for mixing and injecting into a well tubular a dry material/liquid slurry. The apparatus is comprised of an entrainment chamber having an inlet and an outlet, a hopper having an inlet, and an outlet detachably connected to the chamber inlet, a jet nozzle vertically positioned adjacent the hopper outlet and a tubing connector attached to the chamber outlet. Pressurized liquid is passed through the jet nozzle creating a partial vacuum, entraining gravity fed material from the hopper to form a slurry. The slurry passes through the tubing connector and is injected into a well tubular which are detachably connected to the tubing connector.

12 Claims, 4 Drawing Sheets

APPARATUS FOR MIXING AND INJECTING A SLURRY INTO A WELL

BACKGROUND OF THE INVENTION

1. Technical Field

This invention is an oil well equipment apparatus, and more particularly, an apparatus for mixing and injecting into a well tubular a dry material/liquid slurry.

2. Description of Related Art

It is often necessary to perform operations on producing oil wells to restore or increase production. These operations are typically called "work overs." Some work overs involve temporarily "plugging back" a lower subterranean formation or strata with sand or other materials so that operations may be performed on an upper subterranean formation or strata to restore and/or increase the production thereof. Pursuant to this procedure, the lower subterranean formation or strata is covered so that treating fluids can be pumped via a well into the upper subterranean formation or strata without entering the covered lower formation or strata. To effect the plugging back of the lower formation or strata, a dry particular material, such as sand, is mixed with a liquid, such as water, to form a particulate/liquid slurry which is injected into a well penetrating both the upper and lower formation or strata. The sand is deposited in the well and plugs the lower formation or strata thereby allowing work over in the upper formation or strata. Plugging back with sand requires that a uniform continuous slurry of sand and water be injected into the well. Commonly, sand is slowly dumped from a sack into well tubing while being washed down the tubing with water from a hand held hose. Although simple to perform, this method is slow and does not provide a sand/water slurry with a uniform composition. Alternatively, a premixed slurry of sand and gelled water ha been pumped into the well tubing. This method provides a consistent and uniform sand/water slurry, but requires a gel which is an added expense and is time consuming to prepare. Further, this method requires special equipment and labor to mix and pump the slurry which adds expense to the method.

Early attempts to develop mixture apparatus are exemplified by U.S. Pat. No. 4,444,277 to Lewis which discloses an apparatus and an associated method for conditioning or reconditioning oil well drilling mud, comprising multiple hoppers for holding dry additive. Each hopper has a mechanism permitting the additive to be fed into an entrainment chamber at pre-selected rates. An auger is used to force the dry additive through an adjustable gate valve to control the additive flow rate into the entrainment chamber. The additives are mixed at controlled rates with a free jet of mud forced perpendicularly across the entrainment chamber. The mud with entrained additives is collected in a reservoir from which it is forced by a high pressure well pump into a drill stem.

U.S. Pat. No. 4,944,347 to Richard and Johnson discloses an apparatus for providing a direct high velocity, consistent, uniform preparation of completion/workover systems for use in a subterranean well. The apparatus has a screw type conveyor extending through a mixing housing which is in direct communication with a pump. Passageways are provided through the housing for a screw type rotatable conveyor and through a mixing chamber housing in axial alignment with openings in a pump such hat the diametric area between the interior of the housing and the exterior of the conveyor housing provides sufficient transport velocity for the carrier fluid and the solid particular matter from the point of mixing in the annulus, through the annulus and to the inlet of the pump. A pump injects the carrier fluid/particular matter mixture into a fluid transmission conduit and therefrom into a well.

U.S. Pat. No. 2,005,800 to Boyle discloses a mixing apparatus for mixing well drilling fluids. The apparatus comprises a tubular container having a hopper arranged to deliver material into the container. A water line enters the container and terminates in the container at a jet nozzle located underneath and adjacent the hopper. The water line has a valve accessible from the outside of the container and arranged to regulate water flow through the water line and into the jet nozzle. A mixing device is also incorporated into the container downstream of the hopper. The jet nozzle is aligned perpendicular to the fixably attached hopper to entrain material from the hopper in a water jet for the jet nozzle. The water with entrained matter passes through the mixing device and is stored in a vat prior to use.

U.S. Pat. No. 2,372,957 to Keefer discloses an apparatus for storing and feeding an abrasive such as sand to a hydraulic blast gun wherein the sand particles are moved forward by means of a high velocity jet of liquid. The apparatus consists of a hopper or bin adapted to receive and store a quantity of abrasive material. A jet is arranged beneath the hopper to develop a partial vacuum to draw or suck abrasive material into the gun and entrain the material into a liquid stream. The jet is positioned perpendicular to the flow of abrasive from the hopper. The water/abrasive mixture is then used in a hydraulic blast gun for sand blasting type operations.

All of the above cited apparatuses provide dry material/liquid mixing yet are not portable and are not attached directly to a well penetrating a subterranean formation or strata so as to inject uniform material/liquid slurries in to the well. Accordingly, each of the above cited apparatuses require special equipment including pumps to transfer slurries to the wellhead for injection into the well. The above cited apparatuses also do not have hoppers which are detachable from the mixing apparatus to facilitate easy cleaning and maintenance nor do the apparatuses have means for supporting containerized material near the inlet of their hoppers to aid manual pouring of dry material such as bagged sand or cement into the hoppers. Finally, the above cited apparatuses all utilize gravity fed material entrainment by liquid jets from horizontally positioned jet nozzles. This results in an inefficient translation of energy from a vertical to a horizontal plane which is an inefficient use of available gravity and jet energy for mixing. Thus, a need therefore exists for an apparatus which will mix a dry material with a liquid to provide a consistent, uniform material/liquid slurry which can be injected directly into a well yet does not require premixing with a gel. Ideally, this apparatus would be portable, have means for supporting containerized dry material such as shelving to assist manual pouring of bagged materials into the apparatus, have a detachable hopper to facilitate maintenance and cleaning of the apparatus and can be easily attached to and released from the well which is to be worked over. The apparatus would also utilize gravity feeding of dry material and entrainment of the dry material by a vertically directed jet of liquid.

Accordingly, it is an object of the present invention to provide an apparatus for mixing and injecting a dry material/liquid slurry into a well, which is portable, is easily attached to and removed from a well tubular, is comprised of a detachable hopper with means for supporting containerized dry material to assist manual pouring of dry material into the apparatus, and utilizes gravity feeding of dry material from a hopper to a vertically directed liquid jet.

It is a further object of the present invention to provide an apparatus for mixing and injecting a dry material/liquid slurry into a well, which mixes and injects such a slurry at a faster rate than convention apparatuses.

It is a still further object of the present invention to provide such a mixing apparatus which does not require special pumping equipment to transfer the dry material/liquid slurry to the wellhead for injection.

SUMMARY OF THE INVENTION

To achieve the forgoing objects, and in accordance with the purposes of the present invention, as embodied and broadly described herein, the present invention is an apparatus for mixing a dry material with a liquid to form a slurry and for injecting the slurry into a well tubular. The apparatus is comprised of an entrainment chamber having an inlet and an outlet, a hopper having an inlet and an outlet which is detachably connected to the chamber inlet, a jet nozzle vertically positioned adjacent the hopper outlet and a tubing connector attached to the chamber outlet. The jet nozzle has an inlet attached to a pressurized liquid supply and an outlet positioned below the hopper outlet. The tubing connector is removably attachable to a well tubular.

Various embodiments of the apparatus can have screens to prevent foreign bodies from entering the chamber and/or gates to adjust the flow of material from the hopper into the chamber. The apparatus can also have a hopper which has means for supporting containerized material to facilitate manual dumping of materials into the hopper. One embodiment of such support means is shelving.

BRIEF DESCRIPTION OF THE DRAWINGS

The accompanying drawings, which are incorporated in and form a part of the specification, illustrate the embodiments of the present invention and, together with the description, serve to explain the principles of the invention.

In the drawings.

DESCRIPTION OF THE PREFERRED EMBODIMENTS

The present invention is described in the context of specific terms which are defined as follows. A "hopper" is a vessel such as a bin, box, chute, tube, cone or receptacle having an inlet and an outlet. The inlet is relatively larger in size than the outlet such that material fed into the inlet is funnelled to the outlet by force of gravity and force of vacuum created in the entrainment chamber. A "jet nozzle" is any tubular device having an inlet larger than its outlet which causes liquid introduced into the inlet of the jet nozzle to exit the jet nozzle outlet at a high velocity. A "tubing connector" is any fitting capable of joining the apparatus of the present invention to a section of swell tubing. The term "tubing connector" is inclusive of but not limited to such connectors as male-female screw and thread assemblies, male-female tubular assemblies, or tubing collars. A "gate" is any moveable barrier used to regulate the flow of material into the entrainment chamber. The term gate is inclusive of but not limited to, such terms as door, panel, plate, cut-off, and shield.

Figure 1:
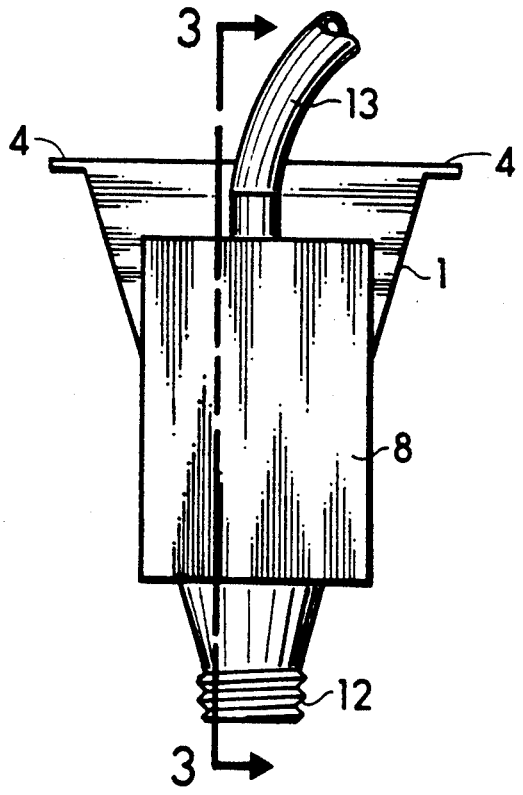
FIG. 1 is a front view of the apparatus of the present invention.
Figure 2:
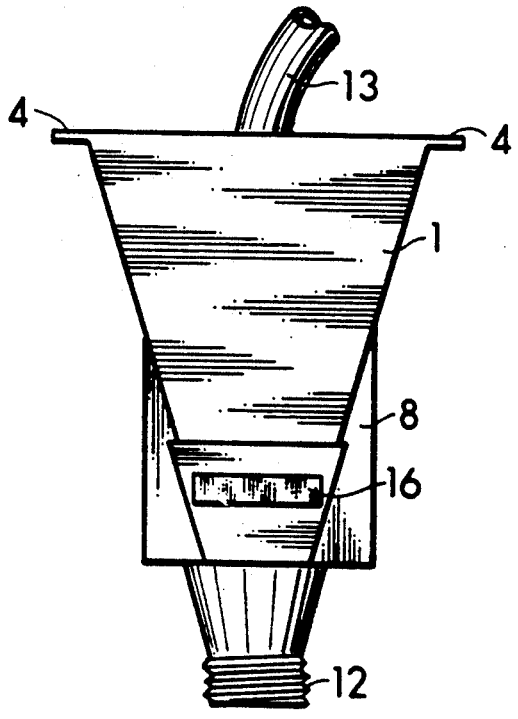
FIG. 2 is a rear view of the apparatus of the present invention.
Figure 3:
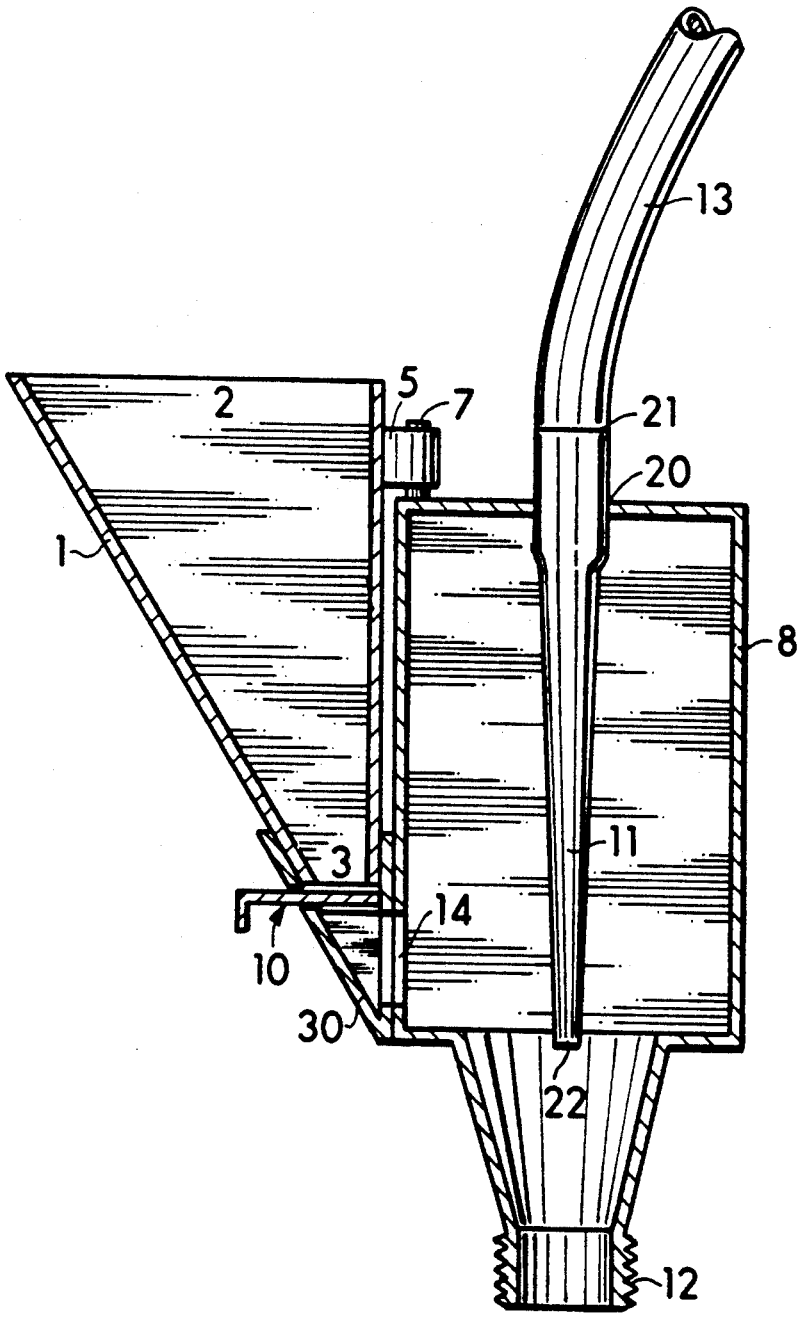
FIG. 3 is a partial cross-sectional view taken along line 3—3 of FIG. 1 illustrating the apparatus with the hopper, entrainment chamber and tubing connector cut-away to reveal the jet nozzle positioned vertically within the entrainment chamber.
Figure 4:
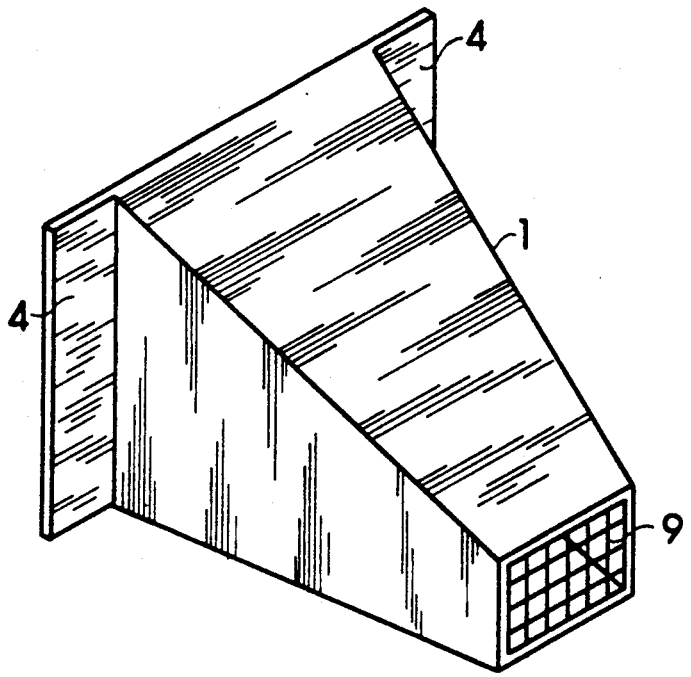
FIG. 4 is a perspective view of the apparatus of the present invention illustrating the outlet of the hopper with a screen in the outlet and shelves to support for containerized material.
Figure 5:
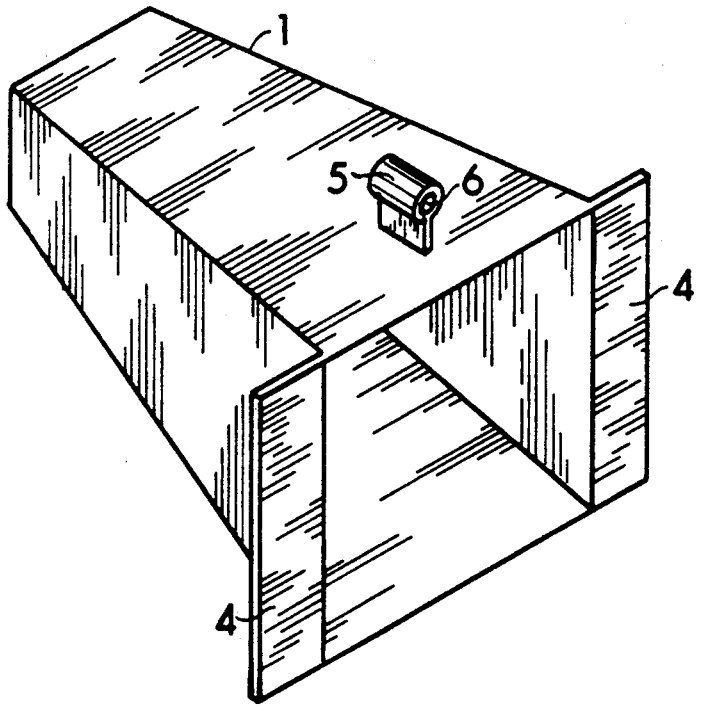
FIG. 5 is a perspective view of the apparatus of the present invention illustrating the means for attaching the hopper to the entrainment chamber.

As illustrated in FIGS. 1–3, the apparatus of the present invention is comprised of a detachable hopper 1, having an inlet 2 and an outlet 3. Hopper 1 has one or more shelves which are attached to or integrally formed with the exterior of the hopper. Although shelves 4 are illustrated as being positioned on the exterior of hopper, shelves 4 can be any means for supporting containerized material and can be located on the interior or exterior of the hopper. Shelves 4 can be utilized alone or in conjunction with multiple supporting means and still be within the scope of this invention so long as the means for supporting containerized material facilitates manual dumping of dry material into hopper 1. Hopper 1 is illustrated in FIGS. 3 and 5 as having an attachment arm 5 which extends from the body of hopper 1 and which has a void 6 to receive pin 7 which is connected to entrainment chamber 8. As will be evident to the skilled artisan, any means can be used to releasably attach hopper 1 to entrainment chamber 8. The outlet 3 of hopper 1 is an opening which may be covered with a mesh screen 9 as illustrated in FIG. 4.

Figure 6:
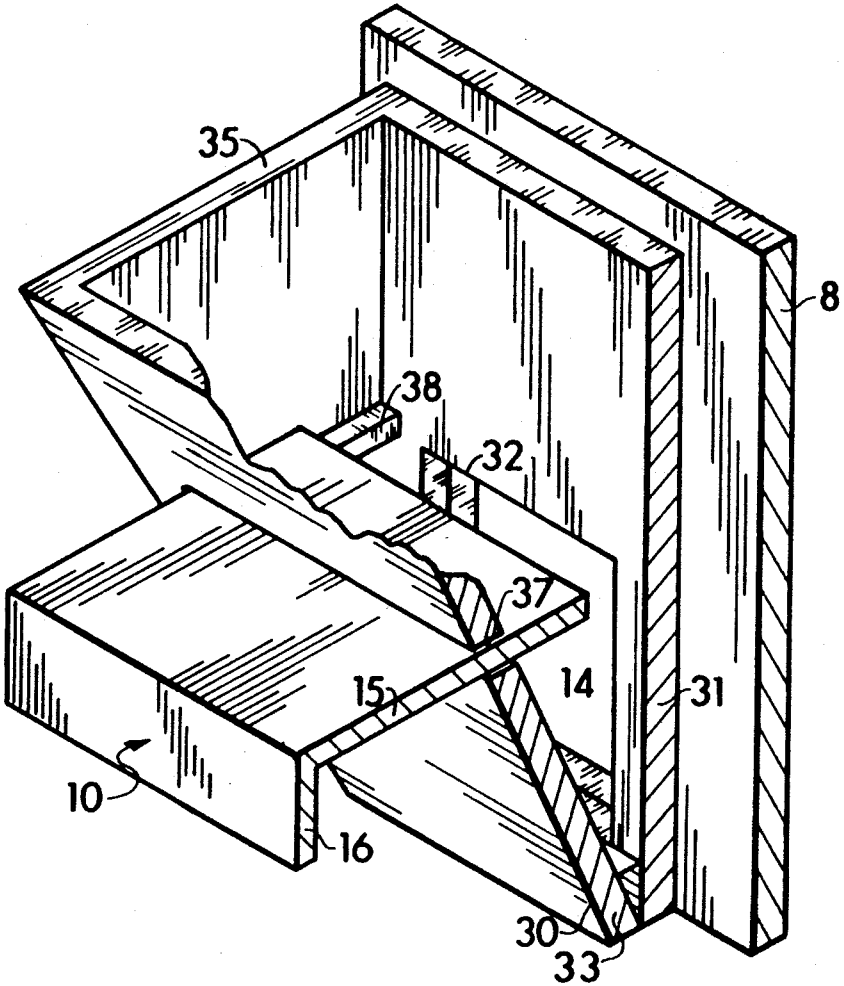
FIG. 6 is a partial cut-away, perspective of the entrainment chamber inlet of the apparatus of the present invention illustrating an adjustable gate being partially open.

An adjustable gate 10 is illustrated in FIGS. 3 and 6 as a rectangular plate 15 having a handle 16 so that gate 10 may be manually opened and closed. As also illustrated in FIGS. 3 and 6, entrainment chamber 8 has an inlet which is a receptacle 30 secured to an outer surface of chamber 8 so as to surround port 14. Receptacle 30 has an aperture 32 through one side 31 thereof which is sized and configured to generally correspond to port 14. The opposite side 33 of receptacle 30 is provided with a slot 37. Guides 38 are provided on the remaining opposing sides 35 of receptacle 30. The upper end of receptacle 30 is sized and configured to receive the outlet 3 of hopper 1 when pin 7 is received within attachment arm 5 as illustrated in FIG. 3. Gate 10 is positioned within slot 37 and supported on two sides by guides 38. Screen 9 at outlet 3 of hopper 1 prevents entry of foreign objects into the chamber. Gate 10 controls the flow of material from hopper 1 into chamber 8. The lower end of entrainment chamber 8 is of a reduced diameter so as to define a tubing connector 12, illustrated with external screw threads, for mating with a well tubular at the wellhead (not illustrated).

The apparatus of the present invention is further comprised of a jet nozzle 11 with an inlet 21 and an outlet 22 shown in FIG. 3. Nozzle 11 extends through an aperture 20 in the upper end of entrainment chamber 8 and is vertically positioned adjacent hopper outlet 3. Where nozzle 11 extends through aperture 20, nozzle 11 is secured to entrainment chamber 8 by any suitable means as will be evident to the skilled artisan. Nozzle inlet 21 is attached to a pressurized liquid supply by hose 13. Nozzle outlet 22 is positioned below hopper outlet 3.

To practice the invention, the apparatus is releasably connected to well tubing (not shown) by tubing connector 12. Pressurized liquid is introduced into jet nozzle 11 via hose 13. Dry material is manually poured into inlet 2 of hopper 1. The material exits hopper 1 at outlet 3 and enters entrainment chamber 8 at inlet 14 under the force of gravity and a partial vacuum created by liquid jetting from nozzle 11. The material is entrained and mixed with liquid from jet nozzle 11 to form a slurry. The material/liquid slurry flows through tubing connector 12 and is injected into tubing connected to tubing connector 12.

Thus, as described above, the instant invention is an apparatus for mixing a dry material with a liquid and injecting the mixture as a slurry directly into well tubing. The apparatus is portable and is comprised of a detachable hopper to aid cleaning and maintenance. The detachability of hopper 1 allows different size hoppers to be attached to entrainment chamber 8 thus allowing for the temporary holding capacity of dry material held by the hopper to be varied. The detachable hopper also readily allows the entrainment chamber to be manually connected, such as by screwing, to a well tubular. The invention has means for supporting containerized material located on the hopper to facilitate manual loading of the hopper with dry material and employs a vertically directed jet of liquid to entrain and mix with dry material gravity fed to an entrainment chamber from the detachable hopper.

While the preferred embodiments have been fully described and depicted for purposes of explaining the principles of the present invention, it will be appreciated by those skilled in the art that modifications and changes may be made thereto without departing from the scope of the invention set forth in the appended claims.

I claim:

1. An apparatus for mixing and injecting a slurry into a well, comprising:

an entrainment chamber having an inlet and an outlet;

a hopper having an inlet and an outlet, said hopper outlet detachably connected to said entrainment chamber inlet;

a jet nozzle having an inlet and an outlet, said nozzle vertically positioned adjacent said hopper outlet, said nozzle inlet attached to a pressurized liquid supply, and said nozzle outlet positioned below said hopper outlet; and a tubing connector attached to said entrainment chamber outlet, said tubing connector adapted to be releasably secured to a well tubular.

2. The apparatus of claim 1 wherein said hopper outlet has a screen to prevent entry of foreign objects into said chamber.

3. The apparatus of claim 1 wherein said entrainment chamber inlet has a gate to adjust the flow of material from said hopper into said chamber.

4. The apparatus of claim 1 wherein said hopper outlet has a screen to prevent entry of foreign objects into said chamber and said entrainment chamber inlet has a gate to adjust the flow of material from said hopper into said chamber.

5. The apparatus of claim 1 wherein said hopper has means for supporting containerized material.

6. The apparatus of claim 2 wherein said hopper has means for supporting containerized material.

7. The apparatus of claim 3 wherein said hopper has means for supporting containerized material.

8. The apparatus of claim 4 wherein said hopper has means for supporting containerized material.

9. The apparatus of claim 5 wherein said support means is shelving.

10. The apparatus of claim 6 wherein said support means is shelving.

11. The apparatus of claim 7 wherein said support means is shelving.

12. The apparatus of claim 8 wherein said support means is shelving.

* * * * *

UNITED STATES PATENT AND TRADEMARK OFFICE

CERTIFICATE OF CORRECTION

PATENT NO. : 5,232,059

DATED : August 3, 1993

INVENTOR(S) : Ellis M. Peterson

It is certified that error appears in the above-identified patent and that said Letters Patent is hereby corrected as shown below:

| | |
|---|---|
| Col. 1, line 68 | Delete "hat" and insert -- that --. |
| Col. 4, line 18 | Delete "swell" and insert -- well --. |

Signed and Sealed this

Eighth Day of March, 1994

Bruce Lehman

*Attest:*

BRUCE LEHMAN

*Attesting Officer*

*Commissioner of Patents and Trademarks*